US007523968B2

(12) United States Patent
Heid et al.

(10) Patent No.: US 7,523,968 B2
(45) **Date of Patent: *Apr. 28, 2009**

(54) REACH OUT LOCK

(75) Inventors: George E. Heid, Rockford, IL (US); Julie K. Earp, Rockford, IL (US); Thomas J. Hansel, Rockford, IL (US); Cheryl Hitchens, South Beloit, IL (US)

(73) Assignee: Andersen Corporation, Bayport, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/767,671

(22) Filed: Jun. 25, 2007

(65) Prior Publication Data

US 2008/0030028 A1 Feb. 7, 2008

Related U.S. Application Data

(63) Continuation of application No. 10/994,444, filed on Nov. 22, 2004, now Pat. No. 7,255,375.

(51) Int. Cl.
*E05C 19/10* (2006.01)
*E05C 3/06* (2006.01)

(52) U.S. Cl. ..... 292/95; 292/112; 292/199; 292/200; 292/280; 292/DIG. 46

(58) Field of Classification Search ..... 292/95, 292/112, 199, 200, 280, DIG. 46
See application file for complete search history.

(56) References Cited

U.S. PATENT DOCUMENTS

| | | | | | |
|---|---|---|---|---|---|
| 897,924 | A | * | 9/1908 | Prouty | 70/100 |
| 1,073,057 | A | * | 9/1913 | Schmid | 292/99 |
| 1,090,305 | A | * | 3/1914 | Hoffman | 70/100 |
| 2,701,156 | A | * | 2/1955 | Palmer, Jr. | 292/113 |
| 3,621,686 | A | * | 11/1971 | Klein | 70/157 |
| 3,806,174 | A | * | 4/1974 | Herman | 292/113 |
| 4,050,272 | A | * | 9/1977 | Tanaka | 70/100 |
| 4,434,635 | A | * | 3/1984 | Borgato | 70/279.1 |
| 4,915,428 | A | * | 4/1990 | Hayakawa | 292/29 |
| 5,595,409 | A | * | 1/1997 | Fier et al. | 292/112 |
| 5,722,704 | A | * | 3/1998 | Chaput et al. | 292/26 |
| 5,775,749 | A | * | 7/1998 | Reithmeyer et al. | 292/341.18 |
| 6,045,169 | A | * | 4/2000 | Frolov | 292/332 |
| 6,079,756 | A | | 6/2000 | Phillips | |
| 6,327,879 | B1 | | 12/2001 | Malsom | |
| 7,029,040 | B2 | | 4/2006 | Lippoldt et al. | |

FOREIGN PATENT DOCUMENTS

| | | | |
|---|---|---|---|
| GB | 2076879 A | * | 12/1981 |
| GB | 2212849 | * | 4/2000 |
| JP | 2001342767 | | 8/2002 |

OTHER PUBLICATIONS

International Search Report / International Application No. PCT/US2005/042260, dated Apr. 4, 2006.

* cited by examiner

*Primary Examiner*—Carlos Lugo
(74) *Attorney, Agent, or Firm*—Womble Carlyle Sandridge & Rice, PLLC

(57) ABSTRACT

A reach out lock for a sliding door includes a keeper having a keeper latch and a locking mechanism having a hook to engage the keeper latch. The reach out lock further includes a mechanism which prevents actuation of the locking mechanism if the locking mechanism is out of alignment with the keeper.

9 Claims, 10 Drawing Sheets

REACH OUT LOCK

CROSS-REFERENCE TO RELATED APPLICATIONS

This application is a continuation of prior U.S. application Ser. No. 10/994,444, filed Nov. 22, 2004, which is expressly incorporated herein by reference and made a part hereof, and upon which a claim of priority is based.

FEDERALLY SPONSORED RESEARCH OR DEVELOPMENT

Not applicable.

TECHNICAL FIELD

The present invention relates to a reach out lock, such as for a two or four panel sliding patio door system.

BACKGROUND OF THE INVENTION

Reach out locks are commonly used to lock sliding glass doors. Reach out locks typically include a hook which extends to lockingly engage a keeper latch. The hook must be properly aligned with the keeper latch in order to properly engage the keeper latch. While they are properly aligned following initial installation, over time the sliding doors may settle, resulting in misalignment. Once sufficiently misaligned, users might think they have locked the doors, unaware that in fact the hook has not actually engaged the keeper latch.

DETAILED DESCRIPTION

Figure 1A:
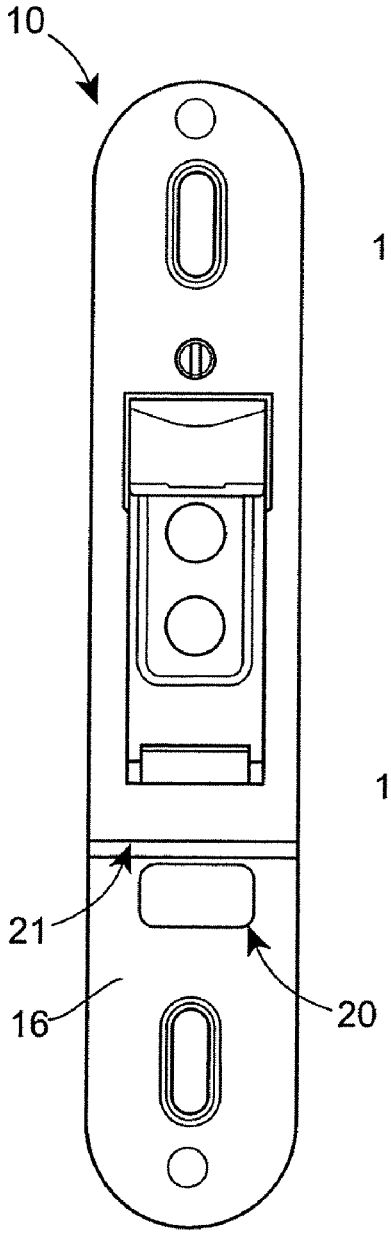
FIG. 1*a* is a front view of a keeper of a first embodiment of a reach out lock according to the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
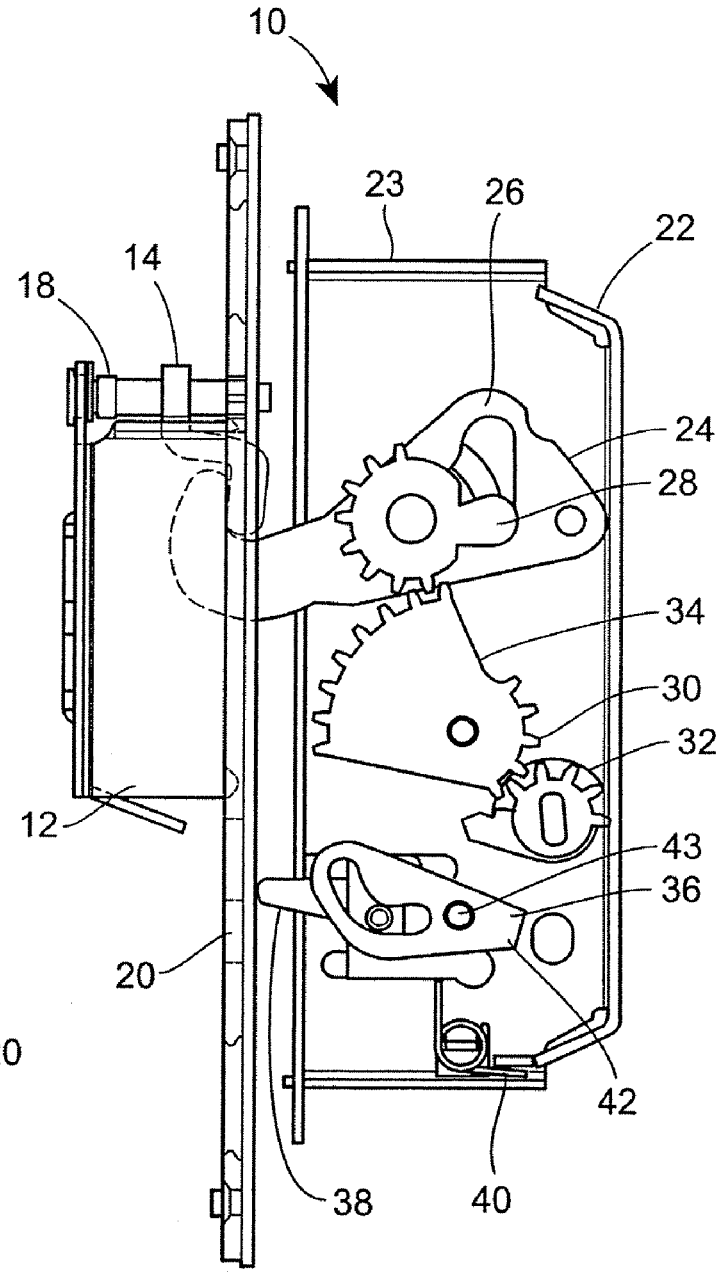
FIG. 1*b* is an exposed, side view of the keeper aligned with a lock mechanism of the reach out lock of FIG. 1*a,* wherein the keeper has a keeper latch, the lock mechanism has a hook to engage the keeper latch, and the hook is in its extended position.
Figure 2:
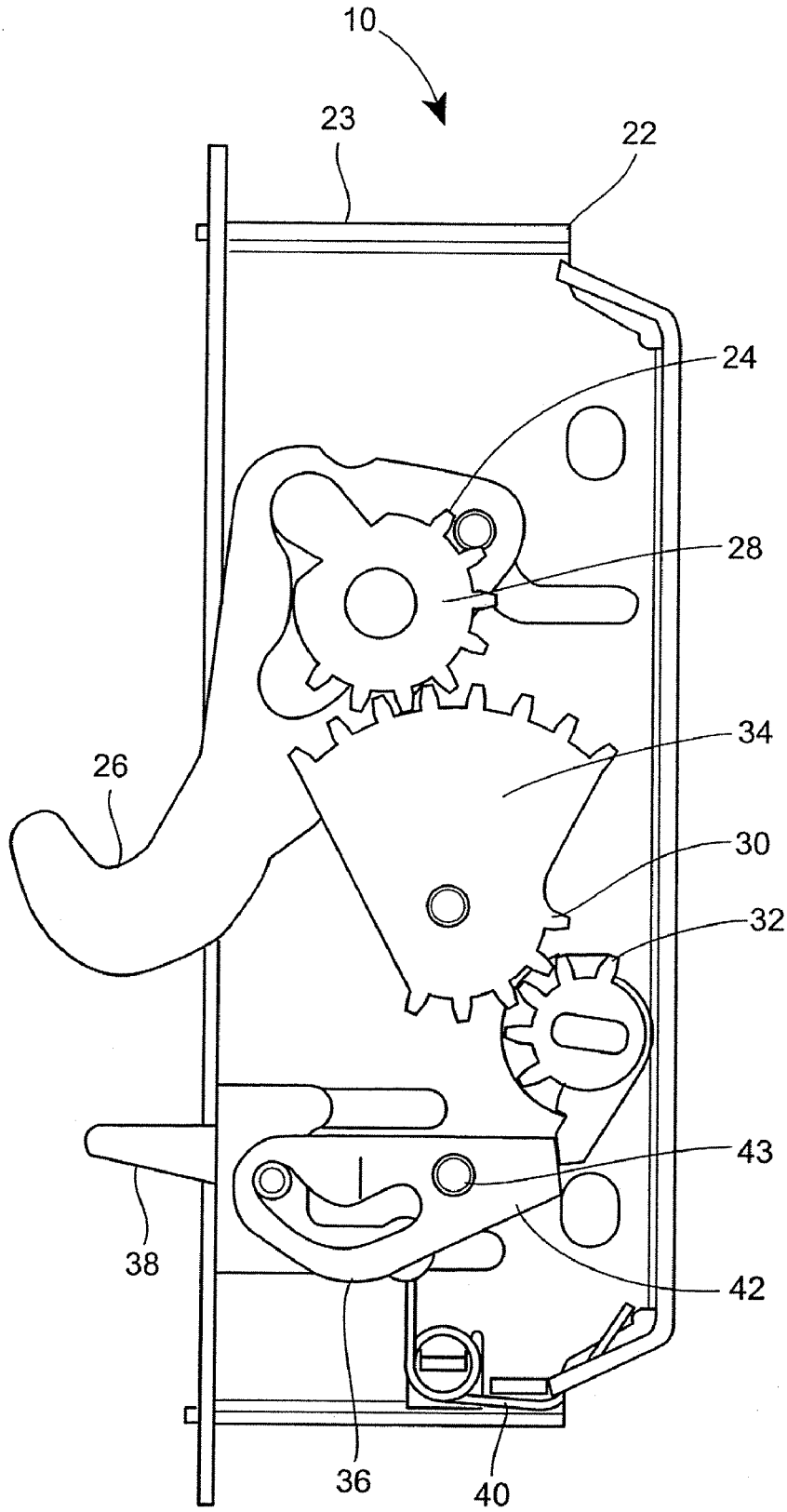
FIG. 2 is an exposed side view of the lock mechanism of FIG. 1*b,* wherein the hook is in its mid position.
Figure 3:
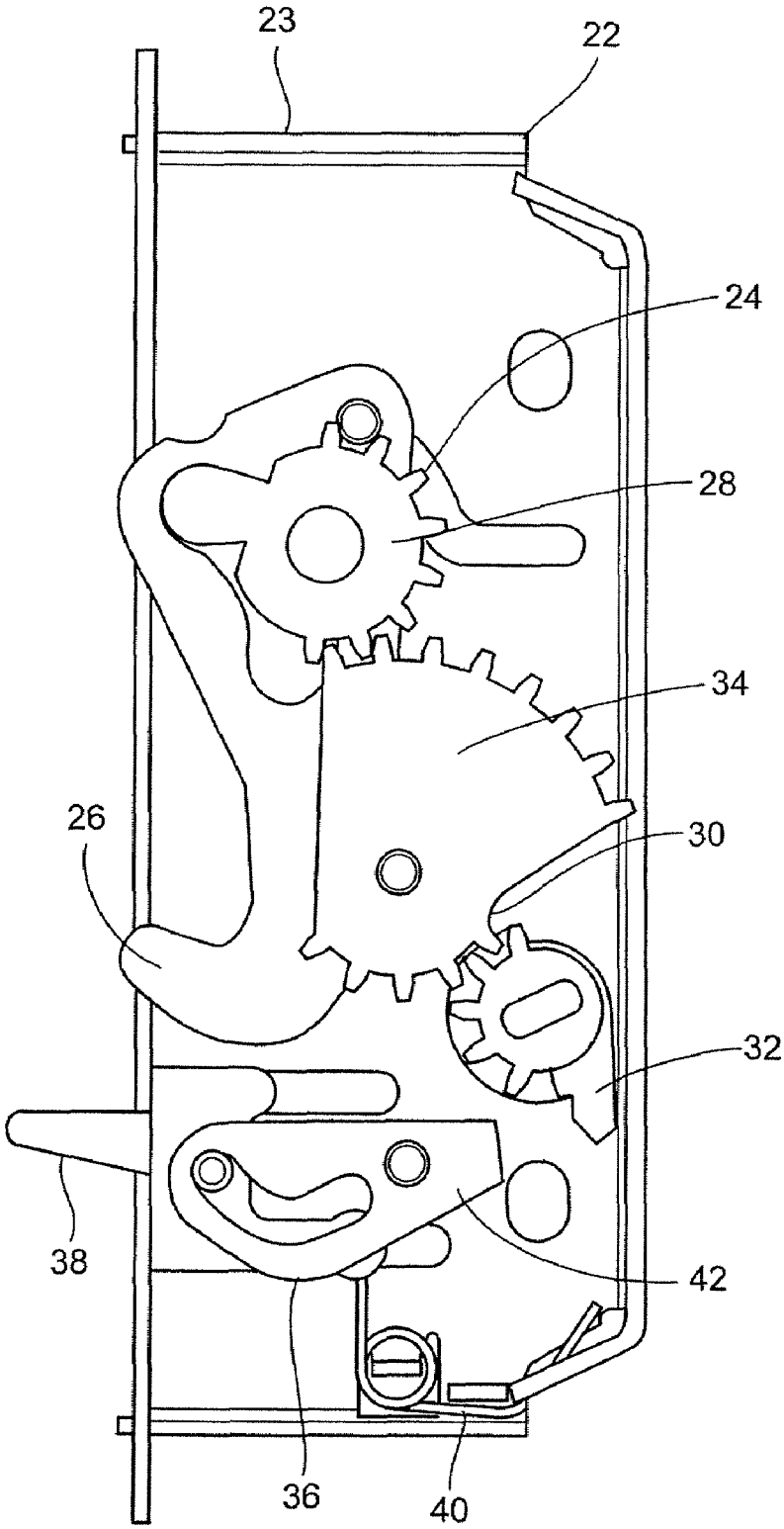
FIG. 3 is an exposed side view of the lock mechanism of FIG. 1*b,* wherein the hook is in its retracted position.
Figure 4A:
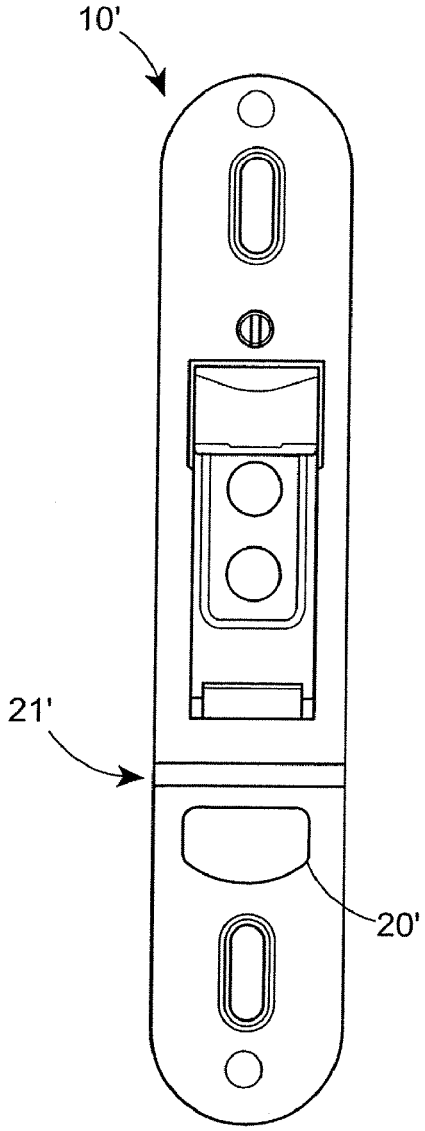
FIG. 4*a* is a front view of a keeper of a second embodiment of a reach out lock according to the present invention.
Figure 4B:
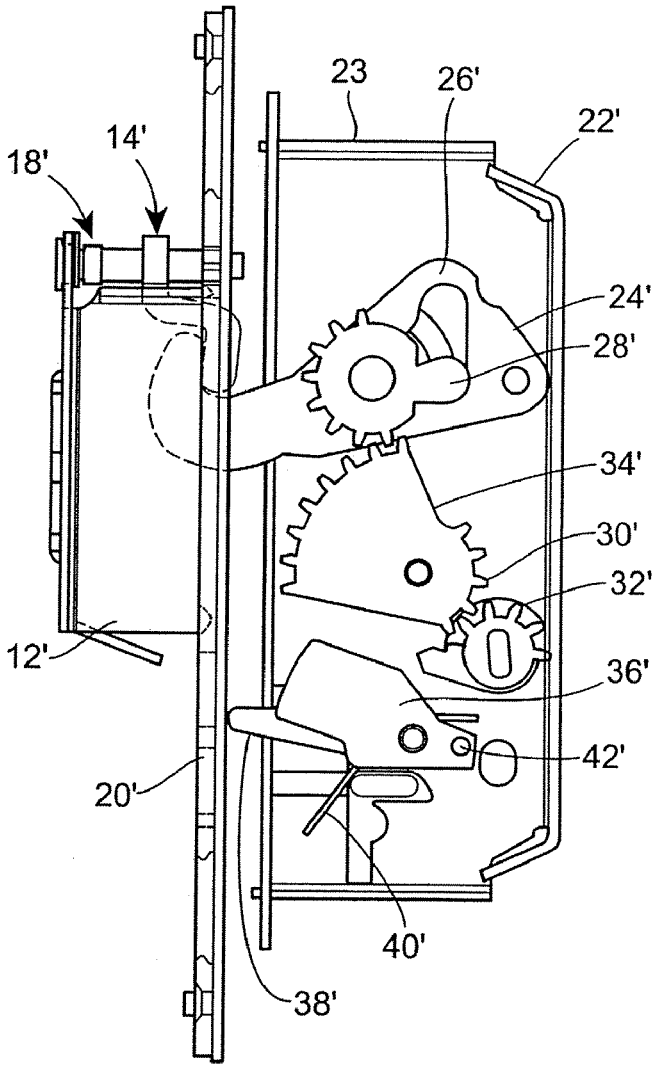
FIG. 4*b* is an exposed, side view of the keeper aligned with a lock mechanism of the reach out lock of FIG. 4*a*, wherein the keeper has a keeper latch, the lock mechanism has a hook to engage the keeper latch, and the hook is in its extended position.
Figure 5:
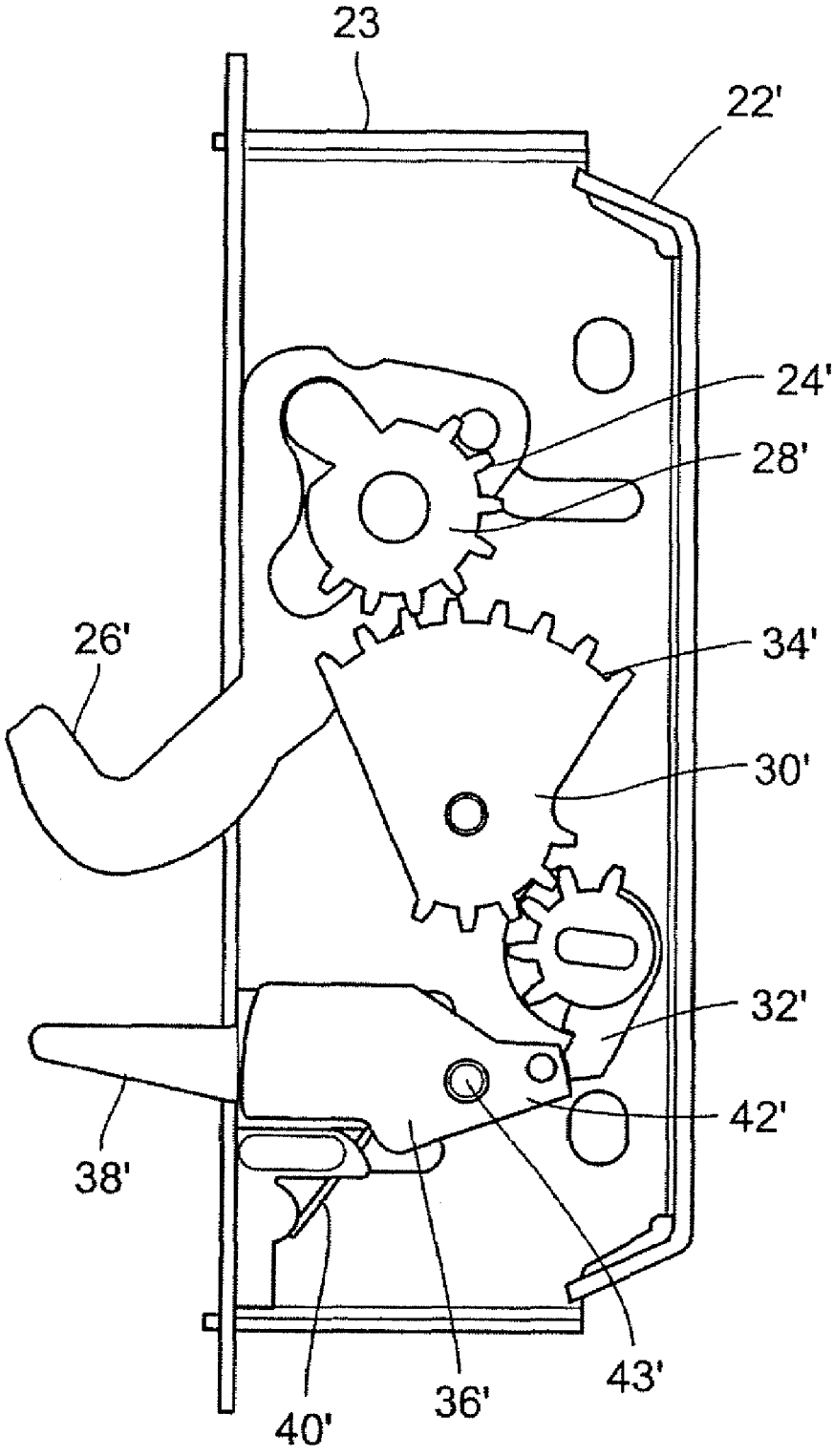
FIG. 5 is an exposed side view of the lock mechanism of FIG. 4*b*, wherein the hook is in its mid position.
Figure 6:
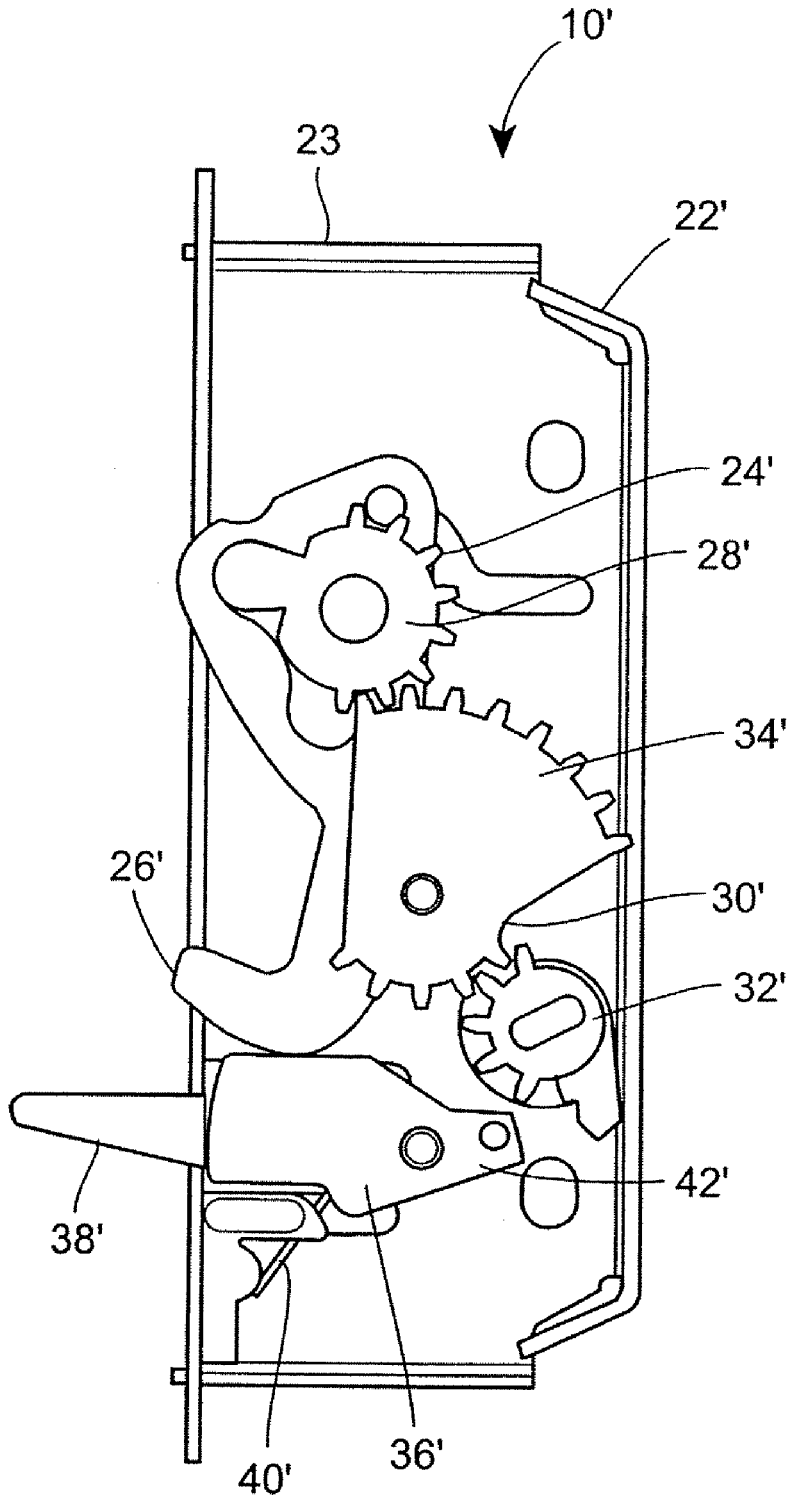
FIG. 6 is an exposed side view of the lock mechanism of FIG. 4*b*, wherein the hook is in its retracted position.
Figure 7:
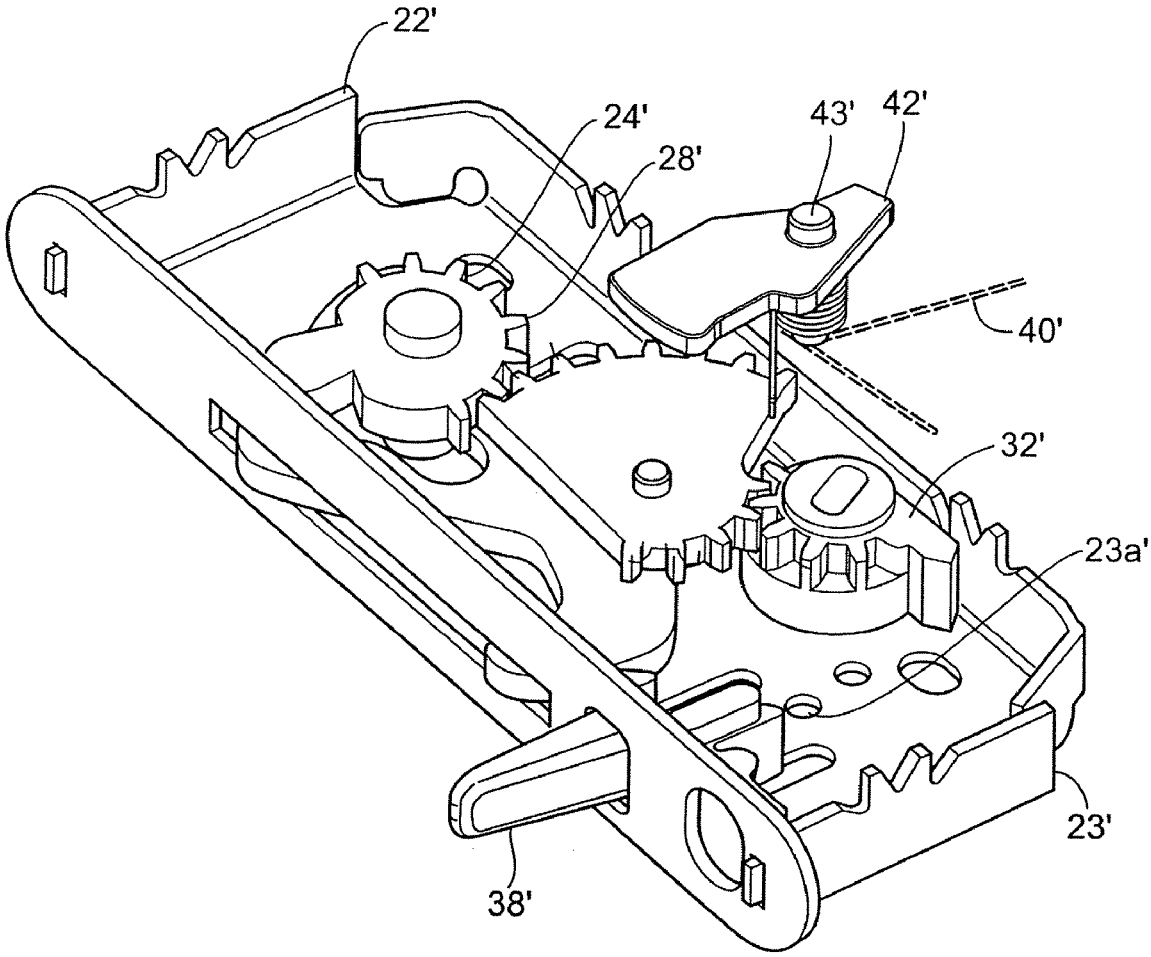
FIG. 7 is a partially exploded view of the lock mechanism of FIG. 4*b;*

A first embodiment of a reach out lock 10, as for locking a sliding door (not shown), is illustrated in FIGS. 1-3. As is well known, sliding doors are operable between an open position and a closed position. A two-panel sliding door system has one sliding panel which typically has a reach out lock to lock the sliding panel to a fixed frame. A four-panel sliding door system has two sliding panels which typically have a reach out lock to lock the two sliding panels together. The reach out lock 10 disclosed herein is for a two-panel sliding door system. The present invention is equally applicable for use with a four-panel sliding door system, but includes known modifications, discussed below.

The reach out lock 10 comprises a keeper 12 having a keeper latch 14 and a keeper faceplate 16. An adjustment screw 18 is provided to permit horizontal adjustment of the keeper 14. The keeper faceplate 16 has a keeper faceplate aperture 20 disposed below an alignment marking 21.

The reach out lock 10 further includes a locking mechanism 22 contained within a housing 23. The housing is closed with a conventional cover plate (not shown). The locking mechanism 22 has a hook mechanism 24 comprising a hook 26 and a drive gear 28 fixedly coupled to the hook 26. The hook 26 is movable between an extended position, as illustrated in FIG. 1*b,* and a retracted position, as illustrated in FIG. 3. When properly installed in a sliding door system, when the hook 26 is moved to its extended position, the hook 26 lockingly engages the keeper 14.

The locking mechanism 22 further includes a user operable crank mechanism 30 comprising a crank 32 and a link gear 34. The link gear 34 is coupled to the drive gear 28. The crank 32 typically includes an external, user-operable actuator (not shown), which a user utilizes to lock, or unlock, the sliding doors.

The locking mechanism 22 further includes an anti-activation mechanism 36. The anti-activation mechanism 36 is provided to prevent a user from extending the hook 26 to the extended position, both when the sliding door is not in its closed position, as well as when the locking mechanism 22 has become mis-aligned relative to the keeper 12.

The anti-activation mechanism 36 includes an anti-activation pin 38 which is outwardly biased by a spring 40. The pin 38 is movable between an outward position, as illustrated in FIG. 2 and 3, and an inward position, as illustrated in FIG. 1*b.* The pin 38 is linked to a pivotably mounted lock plate 42. The lock plate 42 includes a plastic pivot pin 43 which has a first end rotatably disposed in a hole in the housing 23 and a second end rotatably disposed in a hole in the case. When the pin 38 is in its outward position (FIG. 3), the lock plate 42 engages the crank 32 to prevent rotation of the crank 32, which prevents extension of the hook 26 to its extended position. When the pin 38 is in its inward position (FIG. 1*a*), the lock plate 42 does not engage the crank 32, and the hook 26 is free to move to its extended position.

When the door is closed, and the keeper 12 and locking mechanism 22 are properly aligned, the pin 38 will engage the keeper faceplate 16, forcing the pin 38 to its inward position, and permitting rotation of the crank 32 and extension of the hook 26 to its extended, or locking, position.

There are two circumstances when the pin 38 is in its outward position and the lock plate 42 engages the crank 32 to prevent rotation of the crank 32. The first circumstance is when the sliding doors are not closed. In such a case, one cannot accidentally "lock" the sliding door, potentially damaging the door later when the door is subsequently closed.

The second circumstance is when the door on which the locking mechanism 22 is installed has settled a certain amount relative to the structure on which the keeper 12 is installed. In such an instance, when the door is closed, the pin 38 will extend through the keeper faceplate aperture 20, remaining in the outward position, and preventing extension of the hook 26 to its extended, or locking, position. The keeper faceplate aperture 20 is positioned on the faceplate such that the pin 38 will enter the aperture when the locking mechanism 22 has settled to the point that the hook 26 will not adequately engage the keeper 14.

The alignment marking 21 on the keeper faceplate 16 is provided for aligning the pin 38, and thus the locking mechanism 22, with the keeper 12.

A second embodiment of a reach out lock 10' is illustrated in FIGS. 4-7. The second embodiment is substantially the same as the first, but for two significant primary differences. The components of the second embodiment of the reach out lock 10' illustrated in FIGS. 4-7 that are substantially the same as the components described above with respect to the first embodiment of the reach out lock 10 are not described again in detail. Such components are referenced in the drawings using the same reference numbers as the previously-described components, modified by a prime (') designation.

The first primary difference is the length of the anti-activation pin, which is longer in the second embodiment of the reach out lock 10'. The pin 38' was elongated so that the lock 10' can be operated before the weather seal is contacted. This allows the mechanical advantage of the lock 10' to be used to compress the weather seal while locking the door instead of pushing and holding the door against the weather seal and then locking the door. An additional benefit from the elongated pin 38' is that when the door is being adjusted in the field, the alignment between the alignment marking 21 on the keeper and the nose of the pin 38' is visible so it is easier for a home owner to attain optimal adjustment.

Figure 8A:
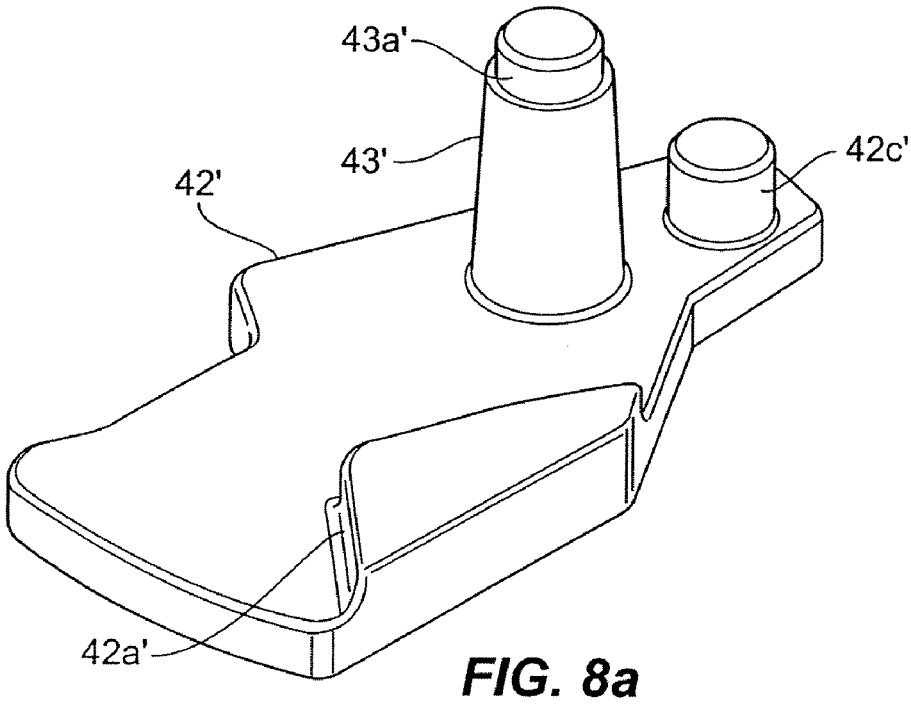
FIGS. 8*a* and 8*b* are respective lower and upper views of the locking plate of the lock mechanism of FIG. 4*b;*
Figure 8B:
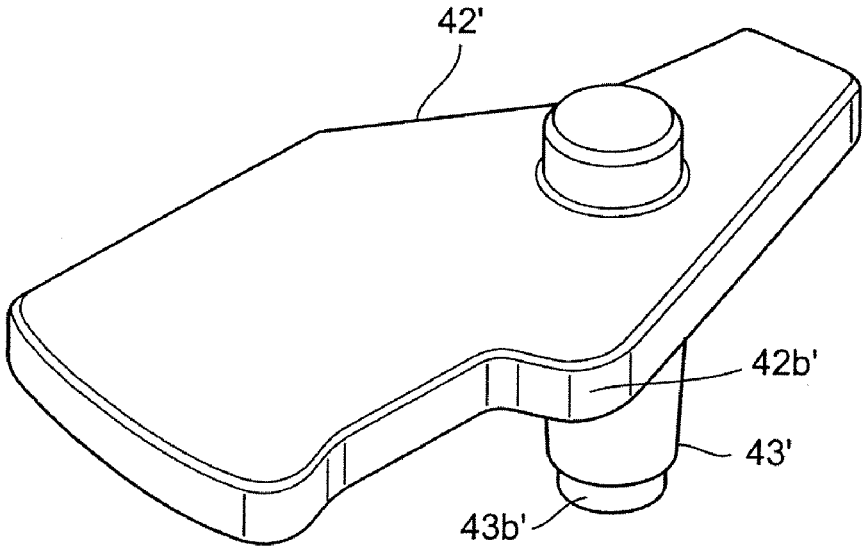
Figure 9A:
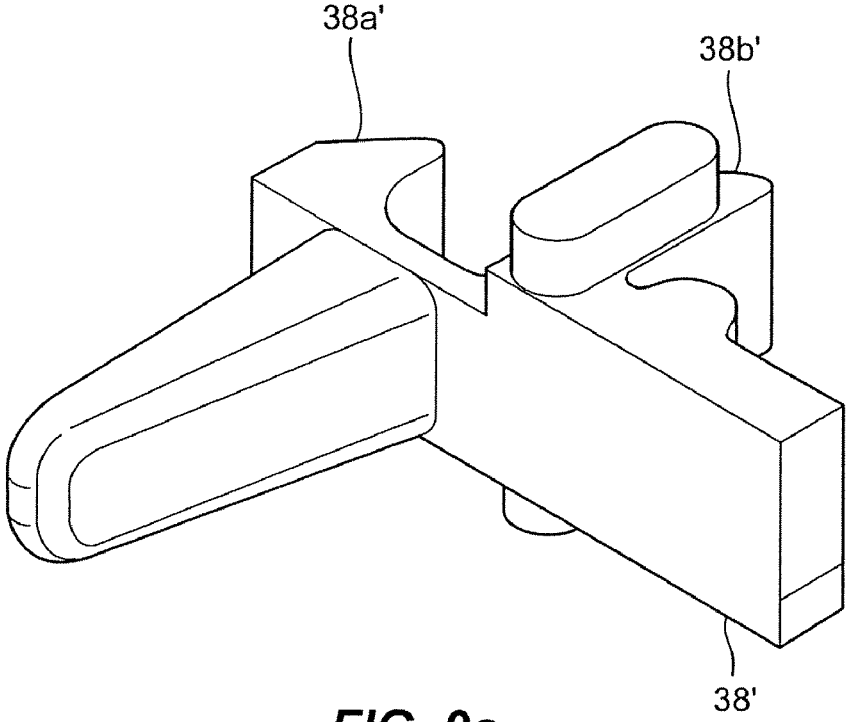
FIGS. 9*a* and 9*b* are respective lower and upper views of the anti-activation pin of the lock mechanism of FIG. 4*b*.
Figure 9B:
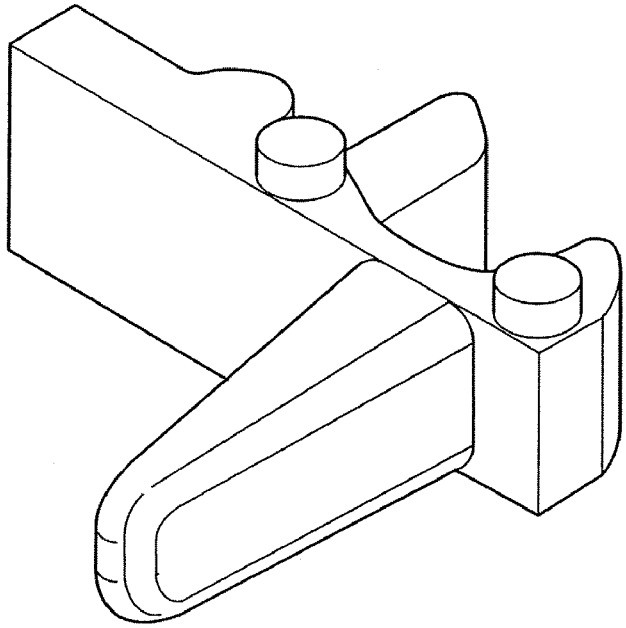

The second significant difference is the lock plate 42 and the anti-activation pin 38. In the second embodiment, the lock plate 42' is formed of zinc and includes an integral pivot pin 43'. The pivot pin 43' is shown in greater detail in FIGS. 8*a* and 8*b*, showing upper and lower views, respectively. The second embodiment of the anti-activation pin 38' is shown in greater detail in FIGS. 9*a* and 9*b*, showing upper and lower views, respectively. Referring to FIGS. 8*a*, 8*b*, 9*a* and 9*b*, the locking plate 42' includes a primary camming surface 42*a'* and a secondary camming surface 42*b'*, which cooperate with a respective primary camming surface 38*a'* and a respective secondary camming surface 38*b'* of the pin 38'. As with the locking plate 42 of the first embodiment, the pivot pin 43' of the second embodiment has a first end 43*a'* rotatably disposed in a hole 23*a'* in the housing 23 and a second end 43*b'* rotatably disposed in a hole in the case. The locking plate 42' further includes a spring stop 42*c'*.

Figure 10:
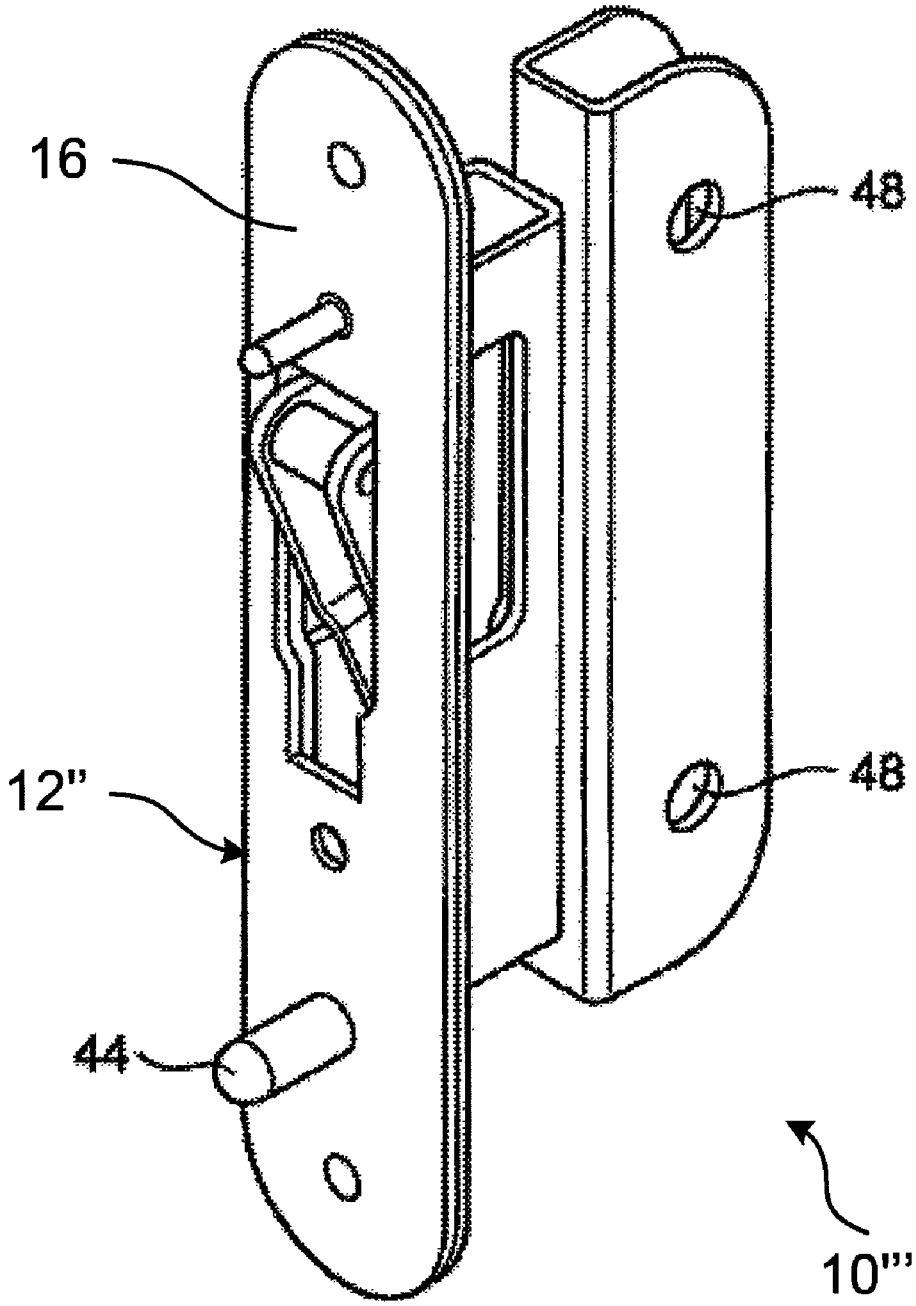
FIG. 10 is a view of a keeper as utilized with a four panel sliding door system.

A keeper 12" for a reach out lock 10'" to be used on a four panel system is illustrated in FIG. 10. The keeper 12" includes a security pin 44 which extends from the keeper faceplate 16 and into the locking mechanism 22. The security pin 44 prevents an intruder from lifting one door relative to the other door. The keeper 12" is mounted in a conventional lock cavity of one of the sliding doors of the four panel system, utilizing screws extending through mounting holes 48.

While specific embodiments have been illustrated and described, numerous modifications may come to mind without significantly departing from the spirit of the invention, and the scope of protection is only limited by the scope of the accompanying Claims.

What is claimed is:

1. For a sliding door operable between an open position and a closed position, a reach out lock for locking the sliding door to an adjacent structure when in the closed position, comprising:

a keeper having a keeper faceplate;

a locking mechanism including a latch member movable between a retracted position and an extended position to engage the keeper when the door is in the closed position; and an anti-activation mechanism operably connected to the locking mechanism for preventing the latch member from extending to the extended position if the latch member is not properly aligned with the keeper, the anti-activation mechanism comprising a pin movable between an outward position and a inward position, wherein when the latch member is correctly aligned with the keeper, the keeper faceplate engages the pin and pushes the pin to the inward position, wherein when the pin is in the outward position, the anti-activation mechanism prevents the latch member from moving to the extended position, and when the pin is in the inward position, the latch member is able to move to the extended position;

wherein the keeper faceplate further comprises an aperture, and wherein when the latch member is misaligned with the keeper, the pin is received in the aperture and the pin remains in the outward position, and the latch member is thereby prevented from moving to the extended position.

2. For a sliding door operable between an open position and a closed position, a reach out lock for locking the sliding door to an adjacent structure when in the closed position, comprising:

a keeper having a keeper faceplate having a faceplate aperture;

a locking mechanism including a latch member movable between a retracted position and an extended position to engage the keeper when the door is in the closed position; and an anti-activation mechanism operably connected to the locking mechanism for preventing the latch member from extending to the extended position if the latch member is not properly aligned with the keeper, the anti-activation mechanism comprising a pin moveable between an outward position and an inward position, wherein when the pin is in the outward position, the anti-activation mechanism prevents the latch member from moving to the extended position, and when the pin is in the inward position, the latch member is able to move to the extended position, and wherein when the latch member is misaligned with the keeper, the pin is received in the faceplate aperture and remains in the outward position, and the anti-activation mechanism prevents the latch member from moving to the extended position.

3. The reach out lock mechanism of claim 2, wherein the anti-activation mechanism further comprises a lock plate operably coupled to the pin, wherein when the pin is in the outward position, the lock plate engages a portion of the locking mechanism to prevent movement of the latch member to the extended position, and when the pin is in the inward position, the lock plate is moved such that the lock plate does not engage the portion of the locking mechanism.

4. The reach out lock mechanism of claim 3, wherein the locking mechanism further comprises a user-operable crank mechanism operably coupled to the latch member for selectively operating the latch member between the retracted position and the extended position, wherein when the pin is in the outward position, the lock plate engages the crank mechanism to prevent movement of the latch member to the extended position.

5. The reach out lock mechanism of claim 2, wherein when the latch member is correctly aligned with the keeper, the keeper faceplate engages the pin and pushes the pin to the retracted position, and the latch member is thereby able to move to the extended position.

6. The reach out lock mechanism of claim 2, further comprising a biasing spring biasing the pin to the outward position.

7. For a sliding door operable between an open position and a closed position, a reach out lock for locking the sliding door to a keeper mounted on an adjacent structure when in the closed position, comprising:

a locking mechanism including a latch member movable between a retracted position and an extended position, the latch member adapted to engage the keeper when the door is in the closed position; and an anti-activation mechanism operably connected to the locking mechanism and configured for preventing the latch member from extending to the extended position if the latch member is not properly aligned with the keeper, the anti-activation mechanism comprising a pin moveable between an outward position and an inward position and a lock plate having an elongated slot therein, wherein the pin has a leg received in the elongated slot, wherein when the pin is in the outward position, the leg engages a first end of the slot to move the lock plate to engage a portion of the locking mechanism and prevent the latch member from moving to the extended position, and when the pin is in the inward position, the leg engages a second end of the slot to move the lock plate so that the latch member is able to move to the extended position;

wherein the anti-activation mechanism is configured so that when the latch member is misaligned with the keeper, the pin is adapted to be received in an aperture on the keeper and the pin remains in the outward position, and the latch member is thereby prevented from moving to the extended position.

8. For a sliding door operable between an open position and a closed position, a reach out lock for locking the sliding door to a keeper mounted on an adjacent structure when in the closed position, comprising:

a locking mechanism including a latch member movable between a retracted position and an extended position, the latch member adapted to engage the keeper when the door is in the closed position; and an anti-activation mechanism operably connected to the locking mechanism and configured for preventing the latch member from extending to the extended position if the latch member is not properly aligned with the keeper, the anti-activation mechanism comprising a pin moveable between an outward position and an inward position, the pin having a first camming surface and a second camming surface, and a lock plate having primary camming surface and a secondary camming surface, wherein when the pin is in the outward position, the lock plate engages a portion of the locking mechanism and prevents the latch member from moving to the extended position, and when the pin is in the inward position, the first camming surface of the pin engages the primary camming surface of the lock plate and the second camming surface of the pin engages the secondary camming surface of the lock plate to move the lock plate so that the latch member is able to move to the extended position, wherein the anti-activation mechanism is configured so that when the latch member is misaligned with the keeper, the pin is adapted to be received in an aperture on the keeper and the pin remains in the outward position, and the latch member is thereby prevented from moving to the extended position.

9. A lock for locking a door to an adjacent structure comprising:

a keeper mountable to the adjacent structure;

a locking mechanism mountable to the door and having a latch, the locking mechanism being selectively operable to extend the latch to engage the keeper and lock the door when the door is closed;

the locking mechanism including a depressible pin extending toward the keeper and structures coupled to the pin to allow the latch to extend only when the pin is depressed; and an aperture in the keeper positioned to receive the pin when the locking mechanism is misaligned with the keeper and the door is closed so that the pin is not depressed and the latch cannot be extended under conditions of misalignment.

* * * * *